United States Patent [19]

Gray

[11] 3,986,616

[45] Oct. 19, 1976

[54] SHELF

[76] Inventor: Robert Gray, c/o Bay Products Division, American Metal Work, Inc. 8701 Torresdale Ave., Philadelphia, Pa. 19136

[22] Filed: June 24, 1975

[21] Appl. No.: 589,860

[52] U.S. Cl. ..... 211/153; 108/107

[51] Int. Cl.[2] ..... A47B 96/02

[58] Field of Search ..... 108/107, 111, 153, 158, 108/106, 109, 161; 211/153, 135

[56] References Cited

UNITED STATES PATENTS

| | | | |
|---|---|---|---|
| 1,853,840 | 4/1932 | Bailey | 211/153 |
| 3,081,717 | 3/1963 | Yurevich | 108/107 |
| 3,217,671 | 11/1965 | Walsh | 108/111 |
| 3,481,486 | 12/1969 | Squires | 211/153 |
| 3,554,142 | 1/1971 | Sorenson et al. | 248/235 |
| 3,556,309 | 1/1971 | Schreyer | 52/630 |

FOREIGN PATENTS OR APPLICATIONS

| | | | |
|---|---|---|---|
| 225,093 | 1/1957 | Australia | 108/107 |

*Primary Examiner*—Roy D. Frazier
*Assistant Examiner*—William E. Lyddane
*Attorney, Agent, or Firm*—Zachary T. Wobensmith, 2nd; Zachary T. Wobensmith, III

[57] ABSTRACT

A shelf which includes a shelf body with downturned flanges along its longitudinal edges and with end caps in each end of the shelf. The end caps have inturned top and bottom walls and inturned side edge flanges. The end caps top walls are spot welded to the shelf. The end caps have holes in the side edge flanges through which bolts pass as well as through holes in the shelf flanges providing for attachment of the shelving to uprights with increased shear strength resistance at the points of attachment.

4 Claims, 5 Drawing Figures

SHELF

BACKGROUND OF THE INVENTION

1. Field of the Invention

A shelf is provided of the sheet metal type with downturned shelf edges and end caps welded into the ends of the shelf body.

2. Description of the Prior Art

When constructing shelves it is desirable to obtain a shelf that is of the lightest gage metal possible consistent with the strength desired, is resistant to bending and is resistant to shear at the points of attachment to the shelf vertical support structure. Examples of shelving systems are shown in the U.S. Pats. to McElray No. 3,100,460, Schreyer No. 3,556,309, Staples No. 1,560,436, Bales No. 2,374,658 and to Squires No. 3,481,486. The Squires patent shows a shelf with downturned longitudinal flanges and with end caps inside the shelf body. While such structures are usable they do not provide the desired strength characteristics, are complicated to manufacture and lack other advantages possessed by the structure of my invention.

SUMMARY OF THE INVENTION

This invention relates to a shelf which includes a shelf body having downturned side edge flanges, with end caps in each end of the shelf body secured thereto by welding providing with the flanges increased shear reinforcement at holes through the end caps and flanges which form the points of attachment of the shelf to upright supports.

The principal object of the invention is to provide a shelf which is simple to manufacture and which has doubled shear strength at attachment points.

A further object of the invention is to provide a shelf which requires minimal labor to manufacture.

A further object of the invention is to provide a shelf which has increased lateral stability, and increased resistance to vertical loads.

A further object of the invention is to provide a shelf which has an improved finished appearance.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figures 1, 2, 3, 4, 5:
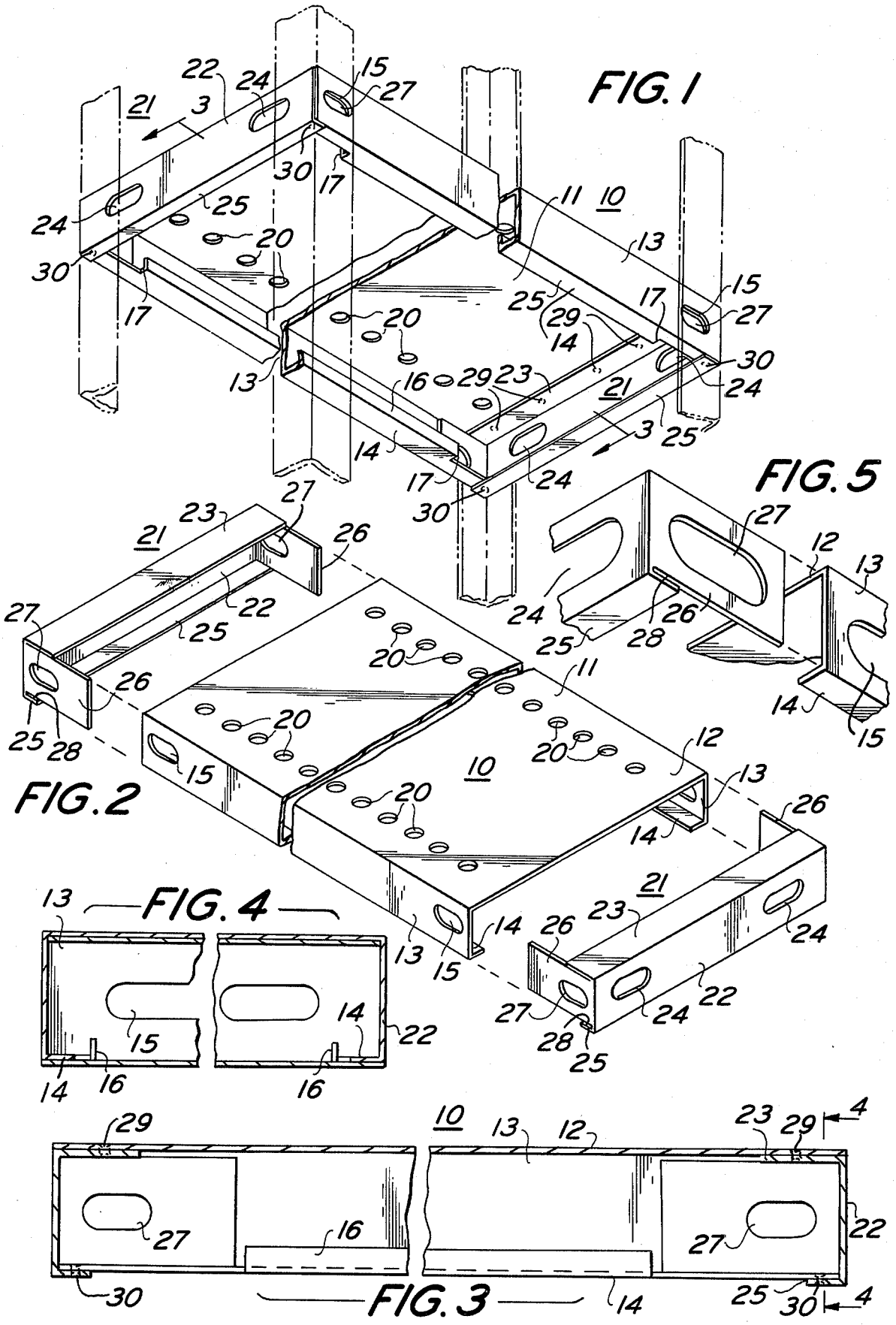
FIG. 1 is a bottom isometric view illustrating the shelf of my invention.
FIG. 2 is an exploded perspective view of the shelf of my invention as seen from the top.
FIG. 3 is a vertical sectional view, enlarged, taken approximately on the line 3—3 of FIG. 1.
FIG. 4 is a vertical sectional view taken approximately on the line 4—4 of FIG. 3.
FIG. 5 is a fragmentary exploded end elevational view showing a portion of the shelf end structure of my invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the shelf 10 as illustrated is preferably formed of sheet metal and includes a shelf body 11 with a flat horizontal top wall 12, which has downturned vertical flanges 13 along its longitudinal edges. The flanges 13 have inwardly extending horizontal ribs 14 for increased stiffness of the flanges 12 and elongated slots 15 adjacent the ends of flanges 12 to provide for attachment to vertical supports (not shown) for shelf mounting. The ribs 14 have vertically extending upright extensions 16 therealong which terminate at a location 17 short of the ends of the shelf body 10. The top wall 12 has a plurality of holes 20 therethrough which extend substantially longitudinally of the wall 12 and may be used for fastening articles, boxes or the like (not shown) to the top wall 12.

The shelf body 11 has end caps 21 at each end which when inserted form the completed shelf 10.

The end caps 21 each has a vertical central wall 22 with a horizontal inwardly extending top wall 23 contiguous thereto and extending the entire width of the interior of the wall 12.

The vertical central wall 22 is provided with elongated slots 24 adjacent each end for attachment to vertical supports (not shown) for shelf mounting. A horizontally extending contiguous bottom wall 25 shorter in length than wall 23 extends inwardly from the vertical wall 22. The vertical central wall 22 has contiguous inturned flanges 26 at each end which are provided with elongated slots 27 aligned with the slots 15 to provide for attachment to vertical supports (not shown) for shelf mounting.

In order to assemble the shelf assembly 10 the end caps 21 have their flanges 26 inserted into the shelf body 11 on the inside of the flanges 13 and the top walls 23 inserted underneath and in contact with the top wall 12. The bottom walls 25, as shown in FIG. 5, which have been bent so as to form slots 28 have the ribs 14 engaged in the slots 28. The top wall 12 and top wall 23 may then be spot welded together as at 29, to form a strong completed shelf 10.

If desired, the bottom walls 25 and the ribs 14 may be spot welded together at their intersection, as at 30, which will provide additional shelf resistance to warpage and bending. The flanges 26 may also be spot welded to the flanges 13 for still further resistance to warpage and bending.

The shelves 10 can be attached to uprights 35 (shown in phantom) by bolts (not shown) passing through slots 15, 27 and 24 with increased shear resistance at slots 15 and 27 due to the double metal thickness. The shelves 10 with the downturned flanges 13 possess increased resistance to downward vertical forces and with the double metal thickness adjacent the ends and the box like integrated structure are resistant to downward vertical forces at the shelf ends.

It will thus be seen that a shelf has been provided with which the objects of the invention are achieved.

I claim:

1. A shelf which comprises a shelf body of sheet metal having a horizontal top wall with downturned vertical flanges along the longitudinal edges of said wall, and inwardly extending horizontal ribs attached to said flanges, said flanges having spaced elongated slots adjacent their ends to provide for attachment of said shelf body, and end caps at each end of said shelf body in contact therewith, said end caps each having an upper horizontal wall portion beneath and in contact with said horizontal top wall, an outer vertical end wall portion extending from said upper wall, vertical side flange portions extending from opposite end edges of said end wall portion inwardly along said vertical flanges beyond said elongated slots and having elongated slots aligned with the slots in said flanges.

2. A shelf as defined in claim 1 in which said upper horizontal wall portions of said end caps and said top wall of said shelf body are secured together.

3. A shelf as defined in claim 1 in which said end caps have horizontal bottom wall portions extending inwardly from the bottom edge of said end wall portion and disposed beneath and in engagement with said ribs.

4. A shelf as defined in claim 3 in which said bottom wall portions of said end caps and said ribs are secured together.

* * * * *